US005190514A

United States Patent [19]

Galvanauskas

[11] Patent Number: 5,190,514

[45] Date of Patent: Mar. 2, 1993

[54] GAP CONTROL APPARATUS FOR FOLD ROLLER

[75] Inventor: Tom Galvanauskas, Palm Bay, Fla.

[73] Assignee: Profold, Inc., Sebastian, Fla.

[21] Appl. No.: 776,087

[22] Filed: Oct. 11, 1991

[51] Int. Cl.[5] ..... B65H 45/14

[52] U.S. Cl. ..... 493/420; 493/442

[58] Field of Search ..... 493/419–421, 493/424, 434, 435, 442, 454, 476

[56] References Cited

U.S. PATENT DOCUMENTS

| | | | |
|---|---|---|---|
| 3,021,134 | 2/1962 | Appell | 493/420 |
| 4,225,128 | 9/1980 | Holyoke | 493/442 |
| 4,496,339 | 1/1985 | Moll | 493/420 |

*Primary Examiner*—Bruce M. Kisliuk
*Assistant Examiner*—Jack Lavinder
*Attorney, Agent, or Firm*—James B. Middleton

[57] ABSTRACT

A paper folder has folding rollers spring urged against the complementary rollers so the rollers touch at the nip when no paper is present. A light spring allows the rollers to open when a piece of paper is to be received therebetween; but, the light spring completely closes after a short movement to limit the gap between the rollers. A heavy spring allows further spacing of the rollers under great force. The resulting folder will fold a range of thicknesses of paper, and including groups of several sheets of paper, without adjustment of the rollers.

4 Claims, 1 Drawing Sheet

GAP CONTROL APPARATUS FOR FOLD ROLLER

INFORMATION DISCLOSURE STATEMENT

Conventional paper folding apparatus includes a plurality of pairs of rollers, and the paper to be folded is fed successively through the nip of the several pair of rollers. A single sheet is usually fed through the first pair of rollers, and the leading end of the sheet is stopped so the sheet of paper buckles. The folded edge of the sheet is then fed through the nip of a second pair of rollers. This procedure continues until the sheet is folded as many times as desired. It will of course be recognized that the nip of each pair of rollers must be set properly to achieve the desired result. If the gap between the rollers of each pair of rollers is too wide, the folded edge will not be a neat crease, but may be a "box fold", or simply wrinkled, or not tightly creased. If the gap is too narrow, the paper may not feed, causing a paper jam in the folding apparatus.

Since the setting of the gaps is very important, there have been numerous efforts to render gap setting easier. The usual solution to the problem is to provide conveniently accessible handles, or knobs, that can be rotated to increase or decrease the gap between each pair of rollers. While such apparatus makes the adjustments accessible, it does not make the adjustments easy, since each nip must be reset for each different thickness of paper.

SUMMARY OF THE INVENTION

This invention relates generally to paper folding apparatus, and is more particularly concerned with a method and apparatus for setting and maintaining an appropriate gap at the nip of fold rollers.

The present invention provides spring means for normally urging a fold roller against the complementary roller, so the folder of the present invention has no initial gap at the nip of the fold rollers. A first spring provides a force of usual magnitude to hold the nip generally closed, but allowing movement of the fold roller under sufficient force. A second spring, in series with the first spring, holds the fold roller completely against the complementary roller. The second spring is designed to exert a very light force, so the fold roller can move away from the complementary roller to allow passage of sheets of paper therebetween. Further, the second spring is relatively short so the spring will be completely closed after only slight compression. The operating folding gap is therefore limited, but is adaptable to the paper being folded, within the predetermined limits.

Apparatus made in accordance with the present invention provides neat folds for papers of a wide variety of thicknesses, and including groups of several sheets of paper simultaneously. In all cases, there is no initial gap at the nip of the fold roller and the complementary roller, and paper is allowed to pass therethrough only by pivoting of the fold roller through compression of the second spring.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
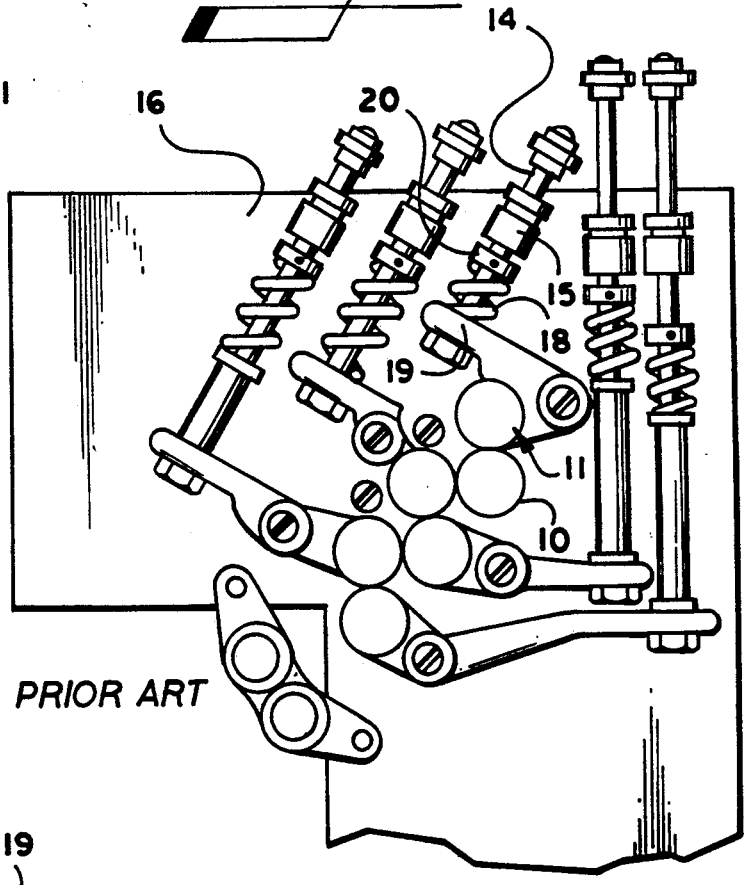
FIG. 1 is a somewhat schematic illustration showing the plurality of rollers used in a folder, and showing the prior art gap adjusting means for the gaps at the nips of the rollers.

Referring now more particularly to the drawings, and to that embodiment of the invention here presented by way of illustration, FIG. 1 shows, somewhat schematically, the plurality of rollers in a conventional paper folder. Each fold roller includes a hanger or the like by which the fold roller can be moved to adjust the gap between the fold roller and its complementary roller. More specifically, there is the main roller 10 which is engaged with the number one fold roller 11, the roller 11 being mounted for pivotal motion about the pivot 12. The roller 11 is moved with respect to the main roller 10 by means of a screw 14 which passes through a block 15 which is fixed to the side plate 16 of the folder. It will also he noticed that there is a spring 18 surrounding the screw 14 and held against the arm 19 by a collar 20.

Those skilled in the art will understand that each of the fold rollers shown in FIG. 1 is carried by an arrangement like that described for roller 11, the location of the pivots varying simply to allow the assembly to fit together. The mechanical arrangement will be discussed in more detail hereinafter, and the one description is applicable to all the fold rollers.

Figure 2:
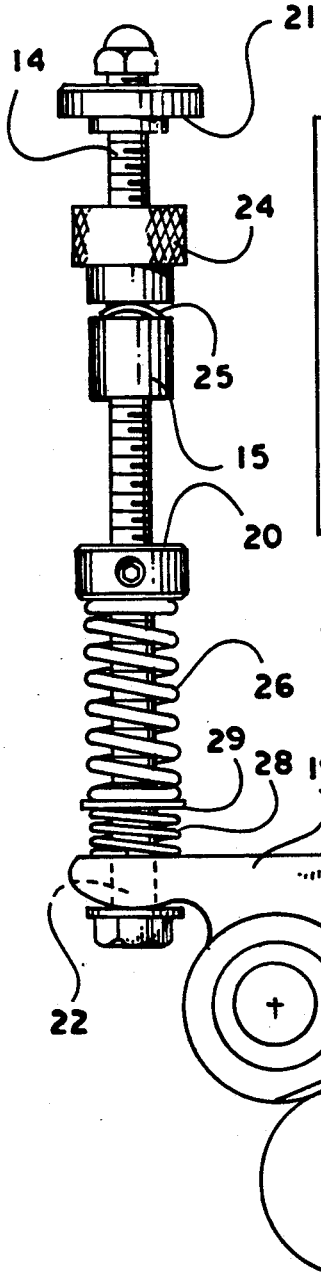
FIG. 2 is an enlarged, side elevational view of one of the adjusting means shown in FIG. 1, modified in accordance with the present invention; and, FIG. 3 is a fragmentary view showing the fold roller of FIG. 2 pivoted away from the complementary roller.

Attention is directed to FIG. 2 of the drawings which shows the fold roller 11 and main roller 10 on a larger scale. FIG. 2 also illustrates the arrangement of the present invention. In FIG. 2 it will be seen that the arm 19 is pivoted at the pivot 12, and carries the roller 11. The screw 14 is fixed to the arm 19, passes through the block 15, and terminates in the knob 21 for normally adjusting the rotational position of the arm 19. These are the same parts that were described in conjunction with FIG. 1, so they carry the same reference numerals. The springs shown in FIG. 2 are different from the spring 18 shown in FIG. 1, so different numerals will be applied.

Looking at the device shown in FIG. 2 in more detail, it will be noted that the arm 19 defines a hole 22 therethrough, the hole 22 being larger in diameter than the screw 14, so the screw 14 and arm 19 can vary angularly with respect to each other. This allows the arm 19 to rotate about the pivot 12 while the screw 14 is held by the block 15.

The screw 14 passes through the block 15, then receives a lock nut 24 and a spring washer 25. Thus, the nut 14 can be screwed down against the block 15 with the spring washer 25 therebetween. This will lock the screw 14 in the selected position, as set by rotation of the knob 21. In using the present invention, it will be understood that the screw 14 will be locked into position as described. It is also possible, when using the present invention, to fix the screw permanently since the adjustments are not required. Nevertheless, the prior art structure is retained, and new springs have been added in accordance with the present invention.

Between the collar 20 and the arm 19, there are two springs, designated at 26 and 28. The spring 26, as shown, normally stands at its free length and extends from the collar 20 substantially to the spring 28. As here shown, there is a washer 29 between the two springs, simply to assure that the ends of the springs are well supported so the springs will not become intertangled. The spring 28 then extends from the washer 29 to the arm 19, again with a washer if desired. The spring 28 exerts a smaller force than the spring 26, and the spring 28 is normally compressed slightly to urge the arm 19 down, to urge the fold roller 11 against the main roller 10.

With the rollers arranged as described above, when a piece of paper is to be fed between the rollers 10 and 11, the roller 11 will move up, away from the roller 10, thereby moving the arm 19 and further compressing the spring 28. Since the force exerted by the spring 28 is relatively light, it will be understood that the roller 11 will move only as much as is required to allow the paper to pass between the roller 10 and 11, and the roller 11 is constantly urged towards the roller 10 to maintain proper feed, and to effect proper folding. However, since the roller 11 is movable, the gap A (FIG. 3) will be automatically adjusted to the thickness of the paper, or papers, being fed therethrough.

Figure 3:
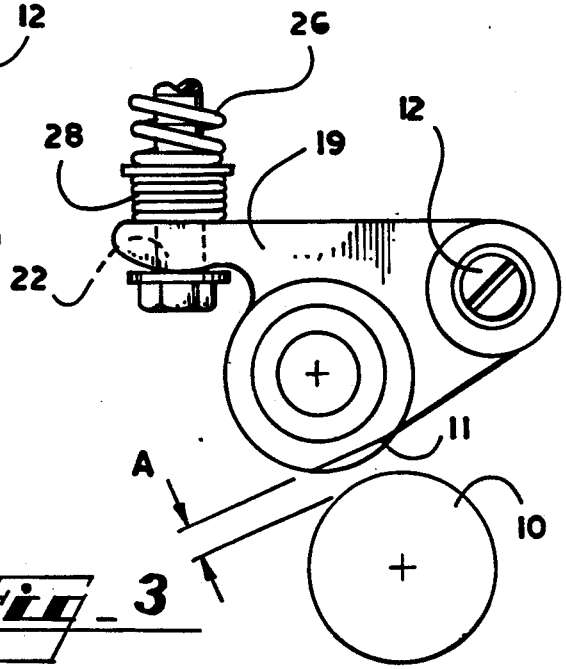

It is contemplated that the spring 28 will allow a limited amount of travel of the arm 19. The limit is set by designing the spring 20 to become completely closed at the desired limit of travel. This condition is shown in FIG. 3 of the drawings, the spring 28 being shown as completely closed while the gap A is at its maximum.

The reason for the effectiveness of the present invention is not completely understood by applicant's attorney, but tests have shown that a folder arranged as described will fold sheets of different thickness without adjustment of the fold rollers. Furthermore, still without adjustment, a plurality of sheets can be folded, even when interspersed with single sheets.

The springs 26 and 28 appear to be critical to proper operation of the present invention, and the general features required have been discussed above. By way of example, a successful folder has been made by using, as spring 26, a spring made of wire having a diameter of 0.085 inch, the spring having a diameter of 1⅜ inch and a length of 2 1/32 inches. The spring exerts 50 pounds of pressure. The spring 28 is made of wire having a diameter of 0.045 inch, the spring having a diameter of 0.625 inch and a length of 0.6 inch. The spring exerts a pressure of 18 pounds. With the above discussed guidelines, those skilled in the art will understand that some variation in each of the springs 26 and 28 is possible.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. Paper folding apparatus including a plurality of fold rollers and a plurality of complementary rollers, each fold roller of said plurality of fold rollers being adjacent to one complementary roller of said plurality of complementary rollers for forming a nip therebetween, each fold roller of said plurality of fold rollers further including a pivot, an arm mounted on said pivot and carrying said fold roller, and a screw received through an opening in said arm so that said arm is movable relative to said screw, characterized by a plurality of springs for normally urging said arm in a first direction to cause said fold roller to engage said complementary roller at said nip, said plurality of springs including a first spring surrounding said screw, and a second spring surrounding said screw and adjacent to said first spring so that said first spring and said second spring are in series with each other, said springs normally urging said fold roller against said complementary roller, said first spring being easily compressible to allow said fold roller to move and open said nip sufficiently for a piece of paper being folded to pass through said nip between said fold roller and said complementary roller.

2. Paper folding apparatus as claimed in claim 1, and including collar means for fixing one end of said second spring with respect to said screw, the opposite end of said second spring being positioned to limit the compression of said first spring.

3. Paper folding apparatus as claimed in claim 2, said first spring having a length such as to allow limited travel of said arm relative to said screw.

4. Paper folding apparatus as claimed in claim 3, said first spring having a total length of about ½ inch and exerting about 18 pounds pressure, said second spring having a total length of about 2 inches and exerting about 50 pounds pressure.

* * * * *